US009099784B2

(12) United States Patent
Jiang et al.

(10) Patent No.: US 9,099,784 B2
(45) Date of Patent: Aug. 4, 2015

(54) ARRAY ANTENNA OF MOBILE TERMINAL AND IMPLEMENTING METHOD THEREOF

(75) Inventors: Hui Jiang, Shenzhen (CN); Hao Ai, Shenzhen (CN); Lu Zhang, Shenzhen (CN); Ying Liu, Shenzhen (CN); Chao Li, Shenzhen (CN)

(73) Assignee: ZTE Corporation (CN)

( * ) Notice: Subject to any disclaimer, the term of this patent is extended or adjusted under 35 U.S.C. 154(b) by 266 days.

(21) Appl. No.: 13/976,700

(22) PCT Filed: Jun. 13, 2011

(86) PCT No.: PCT/CN2011/075666
§ 371 (c)(1),
(2), (4) Date: Jul. 30, 2013

(87) PCT Pub. No.: WO2012/088837
PCT Pub. Date: Jul. 5, 2012

(65) Prior Publication Data

US 2013/0300629 A1 Nov. 14, 2013

(30) Foreign Application Priority Data

Dec. 27, 2010 (CN) ..... 2010 1 0607713

(51) Int. Cl.
*H01Q 1/24* (2006.01)
*H01Q 1/50* (2006.01)
(Continued)

(52) U.S. Cl.
CPC ..... *H01Q 1/50* (2013.01); *H01Q 1/243* (2013.01); *H01Q 9/0407* (2013.01); *H01Q 21/29* (2013.01); *Y10T 29/49016* (2015.01)

(58) Field of Classification Search
CPC ..... H01Q 1/50; H01Q 1/243; H01Q 21/29; H01Q 9/0407; Y10T 29/49016
USPC ..... 343/853, 702, 893; 29/600
See application file for complete search history.

(56) References Cited

U.S. PATENT DOCUMENTS

2007/0132641 A1* 6/2007 Korva et al. ..... 343/700 MS
2008/0231521 A1* 9/2008 Anguera Pros et al. ..... 343/702
(Continued)

FOREIGN PATENT DOCUMENTS

CN 101316008 A 12/2008
CN 101719593 A 1/2010
(Continued)

OTHER PUBLICATIONS

International Search Report mailed Oct. 13, 2011 in PCT Application No. PCT/CN2011/075666.
(Continued)

*Primary Examiner* — Hoanganh Le
(74) *Attorney, Agent, or Firm* — Plumsea Law Group, LLC

(57) ABSTRACT

An antenna array of a mobile terminal and an implementing method thereof are disclosed in this document. The antenna array includes: a mobile terminal floorboard, configured to act as a radiation body to radiate antenna energy coupled by multiple pairs of coupling units, and multiple pairs of coupling units corresponding to multiple antennas, each of which are fixed at two ends of the mobile terminal floorboard and are configured to inspire a waveguide mode of the mobile terminal floorboard to radiate the coupled antenna energy through feed points of feed lines of each coupling unit therein, located at the same side of a dielectric material plate; and a matching circuit located at the other side of the dielectric material plate, connected with the feed points located at the opposite side of the dielectric material plate and configured to implement impedance matching of a micro-strip feed line of each coupling unit.

14 Claims, 4 Drawing Sheets

(51) Int. Cl.
*H01Q 9/04* (2006.01)
*H01Q 21/29* (2006.01)

(56) References Cited

U.S. PATENT DOCUMENTS

| | | | | |
|---|---|---|---|---|
| 2012/0157175 | A1* | 6/2012 | Golko et al. | 455/575.7 |
| 2014/0347225 | A1* | 11/2014 | Harper | 343/702 |

FOREIGN PATENT DOCUMENTS

| | | | |
|---|---|---|---|
| CN | 101697380 | A | 4/2010 |
| CN | 102110900 | A | 6/2011 |

OTHER PUBLICATIONS

Juha Villanen, et al., A Coupling Element-Based Quad-Band Antenna Structure for Mobile Terminals, Microwave and Optical Technology Letters, Nov. 2, 2006; Figs. 1-3, pp. 1278-1279; vol. 49, No. 6, Jun. 2007; Wiley Periodicals, Inc.

* cited by examiner

ARRAY ANTENNA OF MOBILE TERMINAL AND IMPLEMENTING METHOD THEREOF

TECHNICAL FIELD

The present document relates to the antenna technology of mobile terminal, and particularly, to an antenna array in a mobile communication terminal and an implementation method thereof used for a high-capacity data transmission system in wireless communication.

BACKGROUND OF THE RELATED ART

With the rapid development of the wireless communication technology towards the direction of high-capacity, high transmission rate and high reliability, the grave insufficiency of frequency resources has increasingly become a bottleneck which restraints the career development of wireless communication. By summarizing the research achievements of people in wireless communication technology, the most important technology used for improving the spectrum efficiency or increasing the communication capability is the multi-antenna technology.

In the wireless communication, the multi-antennas mainly include three categories. The first category is the sector antenna, it regularly divides the space into a plurality of equal sectors, and signals of all the sectors are non-interfering; The second category is the smart antenna, it can track useful signals in real time and effectively restraint interference signals from other directions at the meantime. The smart antenna technology requires that a spacing between array antennas is about a half of wavelength, so that the signals on all the antennas have better correlated characteristics. The above two categories of multi-antenna technologies mainly use the directivity of array antennas, which belongs to the scope of spatial filtering. The third category is the distributed antenna, which normally uses a reception diversity technique and a transmit diversity technique. The original purpose of using the distributed antennas is to improve the quality of wireless communication in decayed environments. Signals received on all the units can be regarded as independent. In the past, a reception diversity and a transmit diversity are used independently. If the reception diversity and the transmit diversity are used simultaneously, that is, if multiple antennas are simultaneously used to transmit signals at a receiving terminal and a transmitting terminal, such a system is called as a Multi-Input Multi-Output (MIMO) wireless communication system.

Through the perspective of information theory, an MIMO wireless communication system using the distributed antennas has a higher channel capacity than an MIMO wireless communication system using the sector antennas or the smart antenna technology. Meanwhile, with the advance of the Long Term Evolution (LTE) industry, an MIMO antenna system required by the 4th Generation (4G) communication system currently also raises new challenges to the design and evaluation of communication terminal antennas, on one hand, users requires the miniaturized and high-quality user experience, on the other hand, the MIMO antenna system requires that all the antennas have balanced radio frequencies and electromagnetic performances and also have high isolation and low correlation coefficients at the meantime. Therefore, various contradictions have been highlighted in the design of the terminal antennas of LTE system and in the formation stage of system scheme.

At the present, the MIMO technology is used in commercialization in a cell mobile communication system, but applications in the system are also limited by certain factors, and an important limitation factor therein is an antenna. With regard to the antenna array, all factors such as the number of elements thereof, the structure thereof, the placement way of array elements and the form of array elements and so on directly influence the performance of MIMO channels. The MIMO system requires that all antenna elements in the antenna array have less correlation, thus it can be guaranteed that a response matrix of MIMO channels is approximate of a full rank. However, due to the limitations of size and structure of receiver or transmitter of the mobile terminal, antenna elements are always required to be arranged in the extremely limited space as many as possible, and this will make it difficult to implement the high isolation and low correlation of all the antenna elements, which brings great challenges to the design of antenna elements and antenna arrays of the mobile terminal.

SUMMARY OF THE INVENTION

The technical problem required to be solved by the present document is to provide an antenna array of a mobile terminal and an implementation method thereof, which can implement high isolation and low correlation of multi-antenna elements within the limited space of the mobile terminal.

In order to solve the above technical problem, the present document provides an antenna array of a mobile terminal, which comprises a mobile terminal floorboard and multiple coupling units corresponding to multiple antennas located at a same side of a dielectric material plate, and a matching circuit located at the other side of the dielectric material plate, wherein:

the mobile terminal floorboard is configured to: act as a radiation body to radiate antenna energy coupled by multiple coupling units;

every two coupling units of the multiple coupling units are combined into a pair of coupling units, each pair of coupling units are fixed at two ends of the mobile terminal floorboard and are configured to inspire a waveguide mode of the mobile terminal floorboard to radiate the coupled antenna energy through feed points of feed lines of each pair of coupling units; and the matching circuit is connected with the feed points at the other side of the dielectric material plate and is configured to implement impedance matching of a micro-strip feed lines of each coupling unit.

Wherein, each pair of coupling units are coupling units of two vertically folded metal patches which are fixed at front and rear ends and/or top and bottom ends of the mobile terminal floorboard through the feed points, each pair of coupling units respectively correspond to a low-frequency range or a high-frequency range, and the coupling units in the same frequency range are placed in diagonal positions of the mobile terminal floorboard.

Wherein, a decoupling structure with a polygon shape is corroded from a surface of the mobile terminal floorboard close to a coupling unit of metal patches corresponding to the high-frequency range.

Wherein, the vertically folded metal patches constituting the coupling unit are vertically folded rectangle metal patches;

a first coupling unit of rectangle metal patches corresponding to the low-frequency range comprises a first long side, a first short side, a first broadside and a first horizontal spacing of the first coupling unit exceeding the mobile terminal floorboard; a second coupling unit of the rectangle metal patches corresponding to the high-frequency range comprises a second long side, a second short side, a second broadside and a second horizontal spacing of the second coupling unit exceeding the mobile terminal floorboard; a spacing between the first coupling unit and the second coupling unit is further comprised, feed points of a micro-strip feed lines of the first coupling unit and feed points of a micro-strip feed lines of the second coupling unit are respectively located at the dielectric material plate.

Wherein, the decoupling structure corroded from the surface of the mobile terminal floorboard has a rectangle polygon shape, the rectangle polygon comprises a third long side, a third wide side, an inner long side, an inner wide side and a spacing between the rectangle polygon shape and the mobile terminal floorboard formed by the rectangle polygon shape, and further comprises an outer long side, an outer wide side, a horizontal distance and a longitudinal distance located at the mobile terminal floorboard with a positional relation in regard to the mobile terminal floorboard.

Wherein, a matching circuit of the coupling unit corresponding to the low-frequency range comprises lumped elements: a first capacitance, a first inductance and a third inductance connected serially with an input port introduced by the feed points, a second inductance is connected in parallel between a connection point of the first inductance and the third inductance and the coupling unit, and the other end of the third inductance is connected with the coupling unit;

a matching circuit of the coupling unit corresponding to the high-frequency range comprises lumped elements: a second capacitance, a fourth inductance and a third capacitance connected serially with an input port introduced by the feed points, a fifth inductance is connected in parallel between a connection point of the fourth inductance and the third capacitance and the coupling unit, and the other end of the third capacitance is connected with the coupling unit.

In order to solve the above technical problem, the present document provides a method for implementing the foregoing antenna array of the mobile terminal, which comprises:

at one side of a dielectric material plate configured with a mobile terminal floorboard, combining every two of multiple coupling units corresponding to multiple antennas into a pair of coupling units which are respectively fixed at two ends of the mobile terminal floorboard, and placing a matching circuit configured for impedance matching of a micro-strip feed lines of each coupling unit at the other side of the dielectric material plate.

Wherein, the step of combining every two of multiple coupling units corresponding to multiple antennas into a pair of coupling units which are respectively fixed at two ends of the mobile terminal floorboard specifically comprises:

fixing each pair of coupling units formed with coupling units of two vertically folded metal patches at front and rear ends and/or top and bottom ends of the mobile terminal floorboard through feed points, wherein, each pair of coupling units respectively correspond to a low-frequency range or a high-frequency range, and the coupling units in the same frequency range are placed in diagonal positions of the mobile terminal floorboard.

Wherein, the method further comprises:

corroding a decoupling structure with a rectangle polygon shape from a surface of the mobile terminal floorboard close to a coupling unit of metal patches corresponding to the high-frequency range.

Wherein, configuring the matching circuit configured for the impedance matching of the micro-strip feed lines of each coupling unit specifically comprises:

configuring a matching circuit of the coupling unit corresponding to the low-frequency range, wherein a first capacitance, a first inductance and a third inductance are connected serially with an input port introduced by the feed points, a second inductance is connected in parallel between a connection point of the first inductance and the third inductance and the coupling unit, and the other end of the third inductance is connected with the coupling unit;

configuring a matching circuit of the coupling unit corresponding to the high-frequency range, wherein a second capacitance, a fourth inductance and a third capacitance are connected serially with an input port introduced by the feed points, wherein, a fifth inductance is connected in parallel between a connection point of the fourth inductance and the third capacitance and the coupling unit, and the other end of the third capacitance is connected with the coupling unit.

The present document provides an antenna array of a mobile terminal, which comprises a mobile terminal floorboard and multiple pairs of coupling units corresponding to multiple antennas located at a same side as a dielectric material plate, and a matching circuit located at the other side of the dielectric material plate, wherein:

the mobile terminal floorboard is configured to: act as a radiation body to radiate antenna energy coupled by multiple coupling units;

each pair of coupling units include two coupling units, the two coupling units are respectively fixed at two ends of the mobile terminal floorboard, and each coupling unit is configured to: inspire a waveguide mode of the mobile terminal floorboard to radiate the coupled antenna energy through feed points of feed lines of each coupling unit; and the matching circuit is connected with the feed points located at the other side of the dielectric material plate, and the matching circuit is configured to: implement impedance matching of the feed lines of each coupling unit.

Wherein, each pair of coupling units are fixed at front and rear ends and/or top and bottom ends of the mobile terminal floorboard through the feed points of the feed lines of each of the two coupling units contained by each pair of coupling units, each coupling unit is a vertically folded metal patch, and the two coupling units in each pair of coupling units are in the same frequency range, corresponding to a low-frequency range or a high-frequency range, and are placed in diagonal positions of the mobile terminal floorboard.

The antenna array further comprises: a decoupling structure with a polygon shape corroded from a surface of the mobile terminal floorboard close to a coupling unit corresponding to the high-frequency range.

Wherein, each coupling unit is a vertically folded rectangle metal patch;

a coupling unit corresponding to the low-frequency range is a first coupling unit, and the first coupling unit comprises a first long side, a first short side, a first broadside and a first horizontal spacing of the first coupling unit exceeding the mobile terminal floorboard; a coupling unit corresponding to the high-frequency range is a second coupling unit, and the second coupling unit comprises a second long side, a second short side, a second broadside and a second horizontal spacing of the second coupling unit exceeding the mobile terminal floorboard; a spacing exists between the first coupling unit and the second coupling unit located at the same side; feed points of feed lines of the first coupling unit and feed points of feed lines of the second coupling unit are respectively located at the dielectric material plate.

Wherein, the decoupling structure has a rectangle polygon shape, the rectangle polygon comprises a third long side, a third wide side, an inner long side, an inner wide side and a spacing between the rectangle polygon shape and the mobile terminal floorboard formed by the rectangle polygon shape, and further comprises an outer long side, an outer wide side, a horizontal distance and a longitudinal distance located in the mobile terminal floorboard with a positional relation in regard to the mobile terminal floorboard.

Wherein, a matching circuit of the coupling unit corresponding to the low-frequency range comprises lumped elements: a first capacitance, a first inductance and a third inductance connected serially with an input port introduced by the feed points of the feed lines of the coupling unit itself, a second inductance is connected in parallel between a connection point of the first inductance and the third inductance and the coupling unit, and the other end of the third inductance is connected with the coupling unit;

a matching circuit of the coupling unit corresponding to the high-frequency range comprises lumped elements: a second capacitance, a fourth inductance and a third capacitance connected serially with an input port introduced by the feed points of the feed lines of the coupling unit itself, a fifth inductance is connected in parallel between a connection point of the fourth inductance and the third capacitance and the coupling unit, and the other end of the third capacitance is connected with the coupling unit.

The present document further provides a method for implementing the above antenna array of the mobile terminal, which comprises:

at the side of a dielectric material plate configured with a mobile terminal floorboard, combining, in pair, coupling units into multiple pairs of coupling units corresponding to multiple antennas, respectively fixing the two coupling units in each pair of coupling units at two ends of the mobile terminal floorboard, and placing a matching circuit configured for impedance matching of feed lines of each coupling unit at the other side of the dielectric material plate.

Wherein, the step of respectively fixing the two coupling units in each pair of coupling units at two ends of the mobile terminal floorboard comprises:

combining two vertically folded metal patches into a pair of coupling units, and fixing the pair of coupling units at front and rear ends and/or top and bottom ends of the mobile terminal floorboard through feed points of feed lines of each coupling unit thereof, wherein, the two coupling units in each pair of coupling units are in the same frequency range, corresponding to a low-frequency range or a high-frequency range, and are placed in diagonal positions of the mobile terminal floorboard.

The method further comprises: corroding a decoupling structure with a rectangle polygon shape from a surface of the mobile terminal floorboard close to a coupling unit corresponding to the high-frequency range.

Wherein, a matching circuit of a coupling unit corresponding to the low-frequency range comprises a first capacitance, a first inductance and a third inductance connected serially with an input port introduced by the feed points of the feed lines of the coupling unit itself, a second inductance is connected in parallel between a connection point of the first inductance and the third inductance and the coupling unit, and the other end of the third inductance is connected with the coupling unit;

a matching circuit of the coupling unit corresponding to the high-frequency range comprises a second capacitance, a fourth inductance and a third capacitance connected serially with an input port introduced by the feed points of the feed lines of the coupling unit itself, a fifth inductance is connected in parallel between a connection point of the fourth inductance and the third capacitance and the coupling unit, and the other end of the third capacitance is connected with the coupling unit.

Through the antenna array with an integration of antenna and floorboard provided by the present document for the mobile terminal, since the waveguide mode of the floorboard is effectively inspired by utilizing the coupling units, the floorboard becomes the radiation body; compared with the existing self-resonant antennas, it can make the thickness of antennas reduce greatly, which is convenient for the miniaturization design of terminal equipment; since the modular design is adopted, the impedance matching of the coupling units at the required frequency ranges can be implemented by simply adjusting the matching circuits; compared with the traditional self-resonant antennas, the implementation of multi-frequency resonance based on the matching network becomes more visualized; since the radiation floorboard uses a rectangle decoupling structure, the correlation between all the antenna elements can be reduced greatly; a co-frequency range work coupling patch unit is placed at the diagonal position opposite to the radiation floorboard, which can significantly reduce the influence of surroundings on the antenna elements, thereby guaranteeing that the antenna array has better omnidirectional radiation characteristic. Therefore, multiple antennas can work simultaneous within a mobile terminal with an extremely small size, thereby enhancing the spectrum efficiency, increasing the channel capacity, and making that the mobile terminal implements the large volume data transmission of wireless communication system become possible.

The theoretical calculation results show that, the antenna array designed by the present document to the mobile terminal can cover the working frequency range 824 MHz~960 MHz at the low frequency and can achieve the working frequency range 1920 MHz~2170 MHz at the high frequency.

PREFERRED EMBODIMENTS OF THE INVENTION

The technical scheme of the present document will be described in detail in combination with the accompanying drawings and preferred examples below. The examples illustrated below are only used to describe and explain the present document, but do not constitute a limitation on the technical scheme of the present document.

In the present document, a principle that a floorboard (or called as a mobile terminal circuit board) acts as a body of radiating energy and all antenna elements act as coupling elements is adopted, since radiation characteristics of antennas of a mobile terminal at low-frequency range (GSM900MH) mainly depend on a waveguide mode of the floorboard (i.e. a physical structure of the floorboard), coupling units of the antennas can serve as simple unresonance units, which inspire the waveguide mode of the floorboard effectively. Therefore, in the present document, the multi-antenna technology is implemented by placing traditional self-resonance antennas and corresponding coupling units in the mobile terminal.

Figure 1:
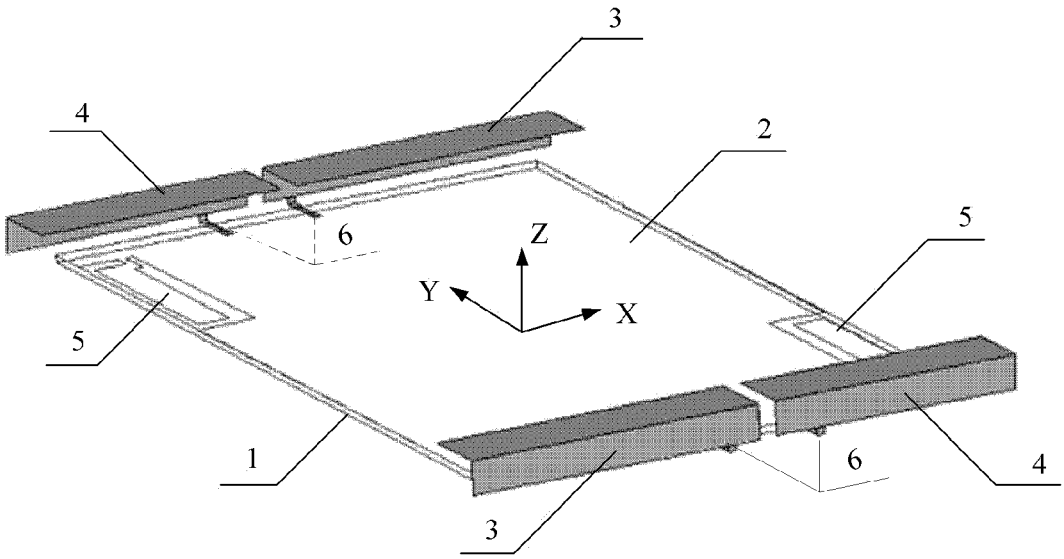
FIG. 1 is a schematic diagram of an overall structure of the example of an antenna array of a mobile terminal according to the present document.

As shown in FIG. 1, an overall structure of the example of an antenna array provided by the present document for the mobile terminal is illustrated, which mainly includes three parts: a floorboard 2 located at the upper side of a dielectric material plate 1, multiple pairs of coupling units 3 and 4, and a matching circuit located at the lower side of the dielectric material plate 1.

The floorboard 2 is configured to: act as a radiation body to radiate antenna energy coupled by the coupling units through feed points 6; and the floorboard 2 is equivalent to a traditional self-resonance antenna.

Each pair of coupling units are configured to: include two coupling units 3 and 4 to inspire and radiate the antenna energy coupled to a waveguide mode of the floorboard 2 through feed points 6 introduced by respective feed lines of the two coupling units (or called as micro-strip feed lines); the antenna radiation modes depend on a size of the floorboard, and a function of the feed points 6 is to inspire it to generate theses modes.

The matching circuit is configured to: implement impedance matching of the micro-strip feed lines with regard to all coupling units.

Wherein, the floorboard 2 uses a waveguide mode with a size of (100±5 mm)×(60±5 mm); and a size of the floorboard 2 is generally set with reference to a size of Printed Circuit Board (PCB) of a terminal (e.g., a mobile phone).

Wherein, the multiple pairs of coupling units include a low-frequency range coupling unit 3 and a high-frequency range coupling unit 4, the low-frequency range coupling unit 3 is fixed at two ends (right and left ends or top and bottom ends) of the floorboard 2, it can be fixed at the two ends (right and left ends or top and bottom ends) of the floorboard 2 in a form of diagonal, and it is a vertically folded rectangle metal patch, and corresponds to a lower frequency range (824 MHz~960 MHz) (or called as a low-frequency range) of a Global System for Mobile Communications (GSM). The high-frequency range coupling unit 4 is fixed at two ends (right and left ends or top and bottom ends) of the floorboard 2, it can be fixed at the two ends (right and left ends or top and bottom ends) of the floorboard 2 in a form of diagonal, and it is a vertically folded rectangle metal patch, and corresponds to an upper frequency range (1920 MHz~2170 MHz) (or called as a high-frequency range) of a Personal Communications Service (PCS). The multiple pairs of coupling units also can include coupling units at other frequency ranges, which specifically depends on frequency range requirements of the mobile terminal and will not be repeated here. But anyway, all pairs of coupling units work at the same frequency range and are respectively fixed at the two ends (right and left ends or top and bottom ends) of the floorboard 2. During the fixing, the coupling units are fixed at the two ends (right and left ends or top and bottom ends) of the floorboard 2 in the form of diagonal.

Wherein, the micro-strip feed lines of the coupling unit 3 and the coupling unit 4 introduce four feed points 6, and the four feed points 6 are located at the lower surface of the dielectric material plate 1.

In the present document, the coupling units correspondingly working at the same frequency range are respectively placed at the two ends of the floorboard 2 and also can be placed at the two ends of the floorboard 2 in the form of diagonal. The coupling unit 3 and the coupling unit 4 are respectively placed at the diagonal positions of the floorboard 2, which can significantly reduce the deterioration degree of antenna omnidirectional pattern characteristic resulted from the influence of surroundings on the antenna elements, thereby guaranteeing that the antenna array in the mobile terminal has better omnidirectional radiation characteristic.

In the present document, in order to implement the object of small correlation of antenna array input ports, a rectangle decoupling structure with a special size is corroded from a surface of the floorboard 2 close to the high-frequency range coupling unit 4 as shown in FIG. 1.

Wherein, the network of the matching circuit uses lumped elements to design respectively with regard to different working frequency ranges. Each coupling unit corresponds to one matching circuit.

Figure 2:
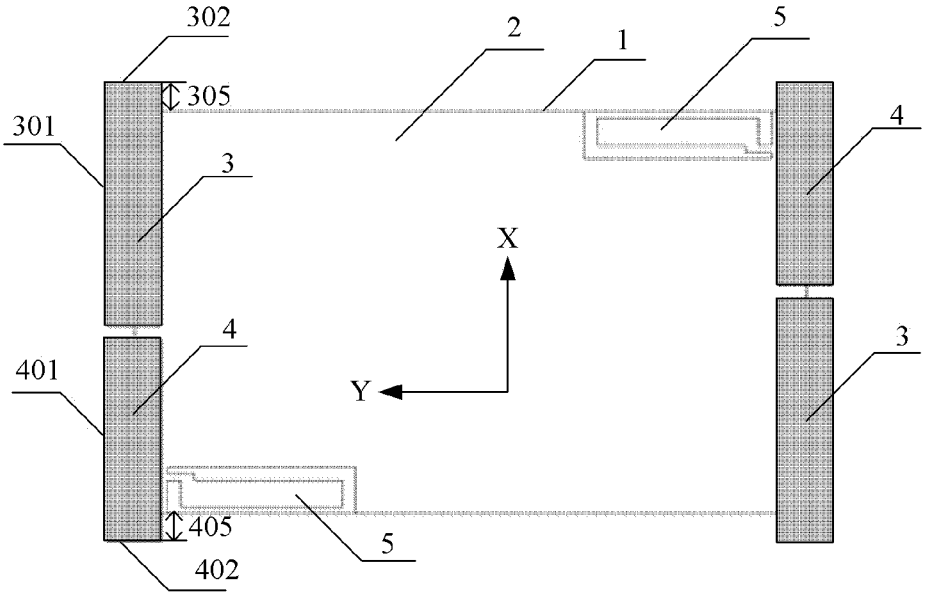
FIG. 2 is a vertical view of structures of coupling units and a radiation floorboard in the example of the antenna array shown in FIG. 1.
Figure 3:
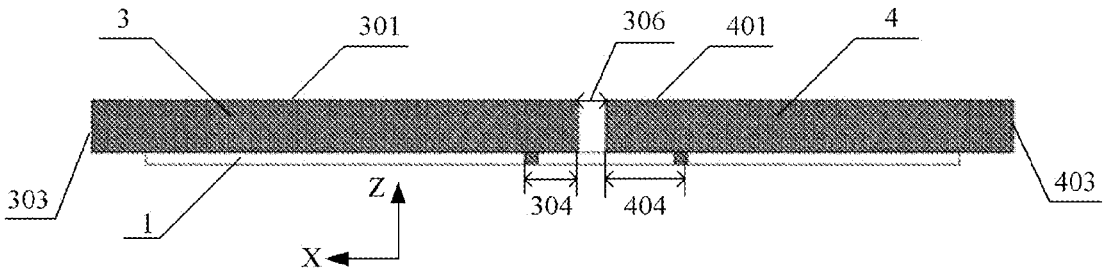
FIG. 3 is a side view of structures of coupling units and a radiation floorboard in the example of the antenna array shown in FIG. 1.

With reference to FIG. 2 and FIG. 3, the coupling units in the antenna array of the present document are designed respectively according to the working frequency ranges, the low-frequency range coupling unit 3 consists of a long side 301, a short side 302, a broadside 303; the high-frequency range coupling unit 4 consists of a long side 401, a short side 402, a broadside 403; the horizontal spacing between the high-frequency range coupling unit 4 and the floorboard 2 and the horizontal spacing between the low-frequency range coupling unit 3 and the floorboard 2 are 405 and 305 respectively, and the spacing between the high-frequency range coupling unit 4 and the low-frequency range coupling unit 3 is 306. Wherein, a position at which the micro-strip feed line of the low-frequency range coupling unit 3 connects with the feed point is 304, and a position at which the micro-strip feed line of the high-frequency range coupling unit 4 connects with the feed point is 404, wherein the length of 404 is larger than the length of 304.

Specifically, for the above example of antenna array, wherein, with regard to the low-frequency range coupling unit 3, the long side 301 of the low-frequency range coupling unit 3 is of 36±1 mm, the short side 302 is of 8±1 mm, the broadside 303 is of 4±1 mm, the feed point position 304 is of 4±1 mm, and the horizontal spacing 305 is of 4±1 mm; with regard to the high-frequency range coupling unit 4, the long side 401 of the low-frequency range coupling unit 3 is of 30±1 mm, the short side 402 is of 8±1 mm, the broadside 403 is of 4±1 mm, the feed point position 404 is of 6±1 mm, and the horizontal spacing 405 is of 4±1 mm. The spacing 306 between the high-frequency range coupling unit 4 and the low-frequency range coupling unit 3 located at the same side is of 2±1 mm. The above specific lengths are determined according to a coupling implementation principle of the antennas and a wavelength computation formula of electromagnetic waves, which will not be repeated here.

Configuration ways of all the coupling units in the above example of antenna array use a modular design according to the need of actual use, and the two coupling units in pair has the same working frequency range and are placed at the front and rear ends of the floorboard 2. A pair of coupling units working at the same frequency range are placed at the two ends of the floorboard 2 and they can be placed in the form of diagonal.

The modular design is a core of the integration design of the antenna array and floorboard of the present document and is also a major advantage of this antenna array composed of the coupling units. The impedance matching of the coupling units at the required frequency ranges can be implemented by simply adjusting the matching circuits. In practical engineering applications, multiple different matching circuits are used to be connected with corresponding multiple coupling units, which implements multi-frequency range resonance to increase the impedance bandwidth. Compared with the scheme in which the traditional self-resonance antenna implements the multi-frequency resonance through a parasitic unit and a high Q resonator between the antennas and feed lines, the design that the antenna array of the coupling units implements the multi-frequency resonance based on the matching network is more visualized.

An FR4 type dielectric material plate 1 with a dielectric constant of 4.4 is selected and used in the present document, the length of the FR4 type dielectric material plate 1 is 100±5 mm, the width is 60±5 mm, and the thickness is 0.8±0.05 mm; the length of the radiation floorboard 2 is 100±5 mm, and the width is 60±5 mm; the total length of the antenna array is 108±1 mm, the total width is 68±1 mm, and the total height is 4.8±0.5 mm.

Examples of other antenna arrays also can be illustrated in the present document, and multiple pairs of coupling units of different working frequency ranges are respectively placed at the top and bottom ends of the floorboard 2 to form more than 4 antenna arrays. Moreover, besides the above folded metal patch structure, the low-frequency range coupling unit 3 and the high-frequency range coupling unit 4 also can have other variant structures, for example, it is to round the dielectric material plate 1 to fold into a cuboid whose section is a rectangle or to roll up into a cylinder structure whose section is a circle or an ellipse or any arcuation.

Figure 4:
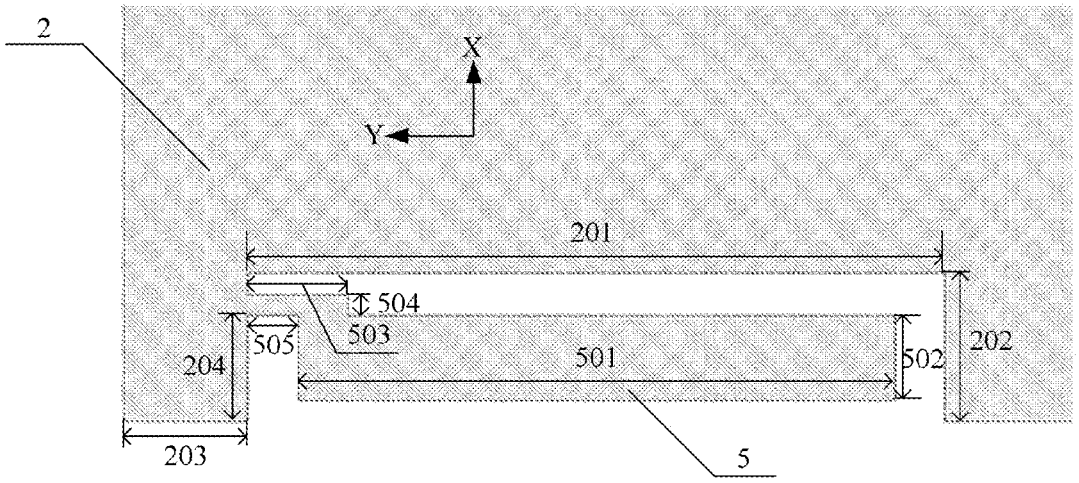
FIG. 4 is a diagram of a rectangle decoupling structure located at the radiation floorboard in the example of the antenna array shown in FIG. 1.

With reference to FIG. 4, a decoupling structure 5 in the above example of antenna array is located at the floorboard 2 and is closed to one side of the high-frequency range coupling unit 4, wherein, the deep color part is the coppersurfaced conductor part, and the light color part is the insulation part where copper is corroded.

The corroded decoupling structure consists of a rectangle polygon 5, the rectangle polygon 5 includes a long side 501, a wide side 502, an inner long side 503, an inner wide side 504 and a floorboard spacing 505 formed by the rectangle polygon, and all the above lengths of sides can be adjusted within a certain scope. There exists a certain location relationship between the rectangle polygon 5 and the floorboard 2, i.e. an outer long side 201, an outer wide side 202, a horizontal distance 203 and a longitudinal distance 204, respectively.

The decoupling structure uses the combined effect of inductance and capacitance to implement a band elimination function, so as to reduce the correlation between the coupling units.

Specifically, for the above example of antenna array, the long side 501 of the rectangle polygon 5 is of 24±1 mm, the wide side 502 is of 4±1 mm, the inner long side 503 is of 4±1 mm, the inner wide side 504 is of 1±0.5 mm and the floorboard spacing 505 is of 2±0.5 mm; the outer long side 201 is of 28 millimeter, the outer wide side 202 is of 7 millimeter, the horizontal distance 203 is of 5±0.5 mm and the longitudinal distance 204 is of 5±0.5 mm. The above specific lengths are determined according to a coupling implementation principle of the antennas and a wavelength computation formula of electromagnetic waves, which will not be repeated here.

All the dimension parameters of the low-frequency range coupling unit and the high-frequency range coupling unit illustrated by the present document through the above examples and the dimension parameters of the decoupling structure are not exclusive, they are basically determined according to the shell size of the mobile terminal.

Figure 5:
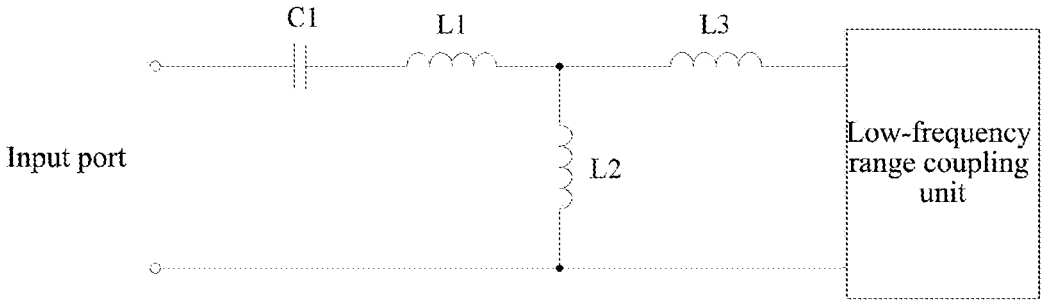
FIG. 5 is a schematic diagram of the structure of a matching circuit at low-frequency range of the example of the antenna array shown in FIG. 1.
Figure 6:
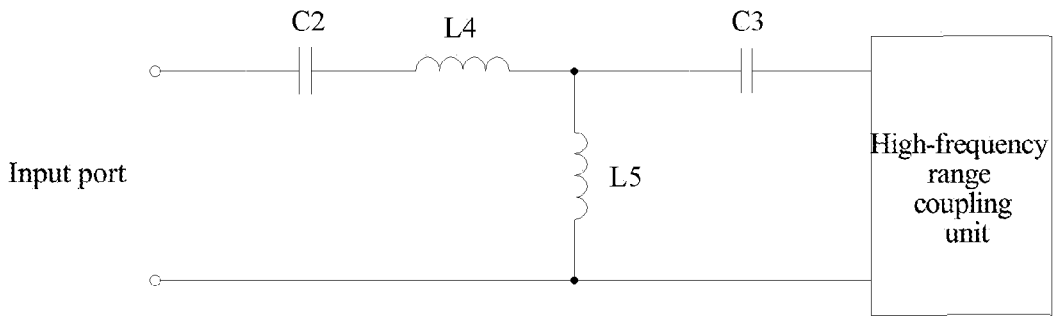
FIG. 6 is a schematic diagram of the structure of a matching circuit at high-frequency range of the example of the antenna array shown in FIG. 1.

With reference to FIG. 5 and FIG. 6, there exists a great difference between the array antennas of the present document and the traditional self-resonance antennas, since the input impedance of antenna ports is low and the port current is comparatively high, it is required to design matching circuits to implement the impedance matching with 50Ω micro-strip feed lines of corresponding coupling units.

A matching circuit corresponding to the low-frequency range coupling unit is as shown in FIG. 5, which comprises lumped elements: a series capacitance C1, a series inductance L1, a parallel inductance L2 and a series inductance L3. Specifically, for the above example of antenna array, the series capacitance C1 is 0.6 pF, the series inductance L1 is 47.9 nH, the parallel inductance L2 is 4.9 nH and the series inductance L3 is 6.2 nH. The magnitude of these capacitances and inductances is specifically determined according to parameter indexes of the antennas, which will not be repeated here.

A matching circuit corresponding to the high-frequency range coupling unit is as shown in FIG. 6, which comprises lumped elements: a series capacitance C2, a series inductance L4, a parallel inductance L5 and a series capacitance C3. Specifically, for the above example of antenna array, the series capacitance C2 is 0.3 pF, the series inductance L4 is 18.3 nH, the parallel inductance L5 is 2.7 nH and the series capacitance C3 is 1.4 pF. The magnitude of these capacitances and inductances is specifically determined according to parameter indexes of the antennas, which will not be repeated here.

Parameter values of all lumped capacitance elements and inductance elements in the above matching circuits can be adjusted within a certain scope according to the working frequency ranges and the changes of input impedance of the coupling units.

The present document provides the example of a method for implementing the above antenna array of the mobile terminal, which includes:

at a side of a dielectric material plate configured with a mobile terminal floorboard, fixing multiple pairs of coupling units corresponding to multiple antennas at two ends of the mobile terminal floorboard, and placing a matching circuit correspondingly configured to implement impedance matching of micro-strip feed lines of each coupling unit at the other side of the dielectric material plate.

Wherein, the multiple pairs of coupling units are respectively two pairs of coupling units (i.e. 4 coupling units) of the vertically folded metal patches, they are divided into a high-frequency range coupling unit group and a low-frequency range coupling unit group according to the high working frequency range and the low working frequency range, all coupling units in each coupling unit group are fixed at front and rear ends or top and bottom ends of the floorboard through feed points of micro-strip feed lines of each coupling unit, and the coupling units of the folded metal patches working at the same frequency range are placed in diagonal positions of the floorboard 2.

Wherein, a decoupling structure with a rectangle polygon is corroded from a surface of the floorboard close to a high-frequency range coupling unit of a folded metal patch. In addition, a decoupling structure with a sawtooth waveform shape or other similar sinusoidal wave shapes also can certainly be corroded from the surface of the floorboard.

Wherein, with respect to the matching circuits introduced by all the coupling units through the feed points of the micro-strip feed lines, the impedance matching of the micro-strip feed lines is implemented by using the lumped elements corresponding to the corresponding working frequency ranges.

Through the above example of method, it enables each coupling unit to most effectively couple the corresponding antenna energy to the floorboard, thereby inspiring the waveguide mode of the floorboard to implement the most effective radiation; and it is difficult for the traditional self-resonance antenna elements to couple the antenna energy and inspire the waveguide mode of the floorboard to radiate the energy while implementing the impedance matching. In addition, the metal patch coupling units correspondingly working at the same frequency range are respectively placed in the diagonal positions of the radiation floorboard, which can guarantee that the antenna array has better omnidirectional radiation characteristic; the design of decoupling structure can effectively reduce the correlation between the coupling units; the matching circuit placed at the other side of the dielectric material plate mainly implements the impedance matching of feed lines of the antenna elements, and thus the antenna size can be reduced greatly, and this makes a big difference from the traditional self-resonance antenna which implements the impedance matching based on the structure of three-dimensional metal antenna elements.

The above advantages of the present document can be further described through the simulations below.

(1) Simulation Contents

Simulation calculations are performed on voltage standing wave ratio and far-field radiation pattern of the above example of the antenna array of the present document by using the simulation software.

(2) Simulation Results

Figure 7:
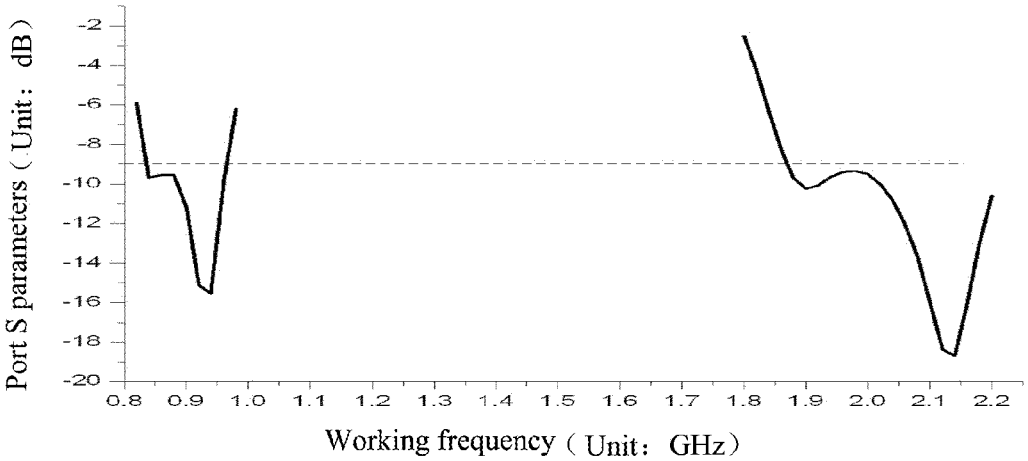
FIG. 7 is a curve chart of working frequencies and port S parameters of the example of the antenna array shown in FIG. 1.

FIG. 7 is a curve chart of working frequencies and port $S_{11}$ parameters (reflection coefficient or return loss) of the antenna array of the present document. As can be seen from FIG. 7, the antenna array of the present document can cover the working frequency ranges 824 MHz~960 MHz and 1920 MHz~2170 MHz in the condition that the port $S_{11}$ parameters are less than −9 dB. It is indicated that the antenna array of the present document has better multi-frequency range characteristic.

Figure 8:
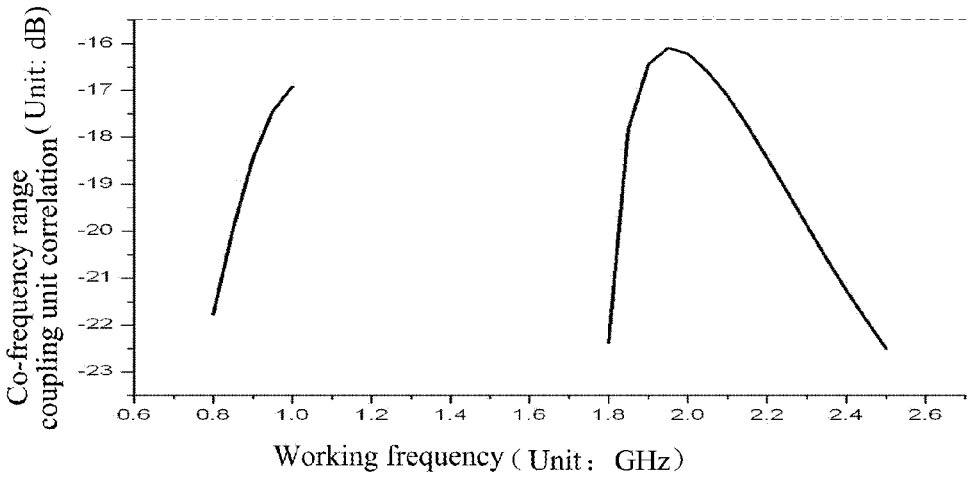
FIG. 8 is a curve chart of working frequency and coupling unit correlation of the example of the antenna array shown in FIG. 1.
Figure 9:
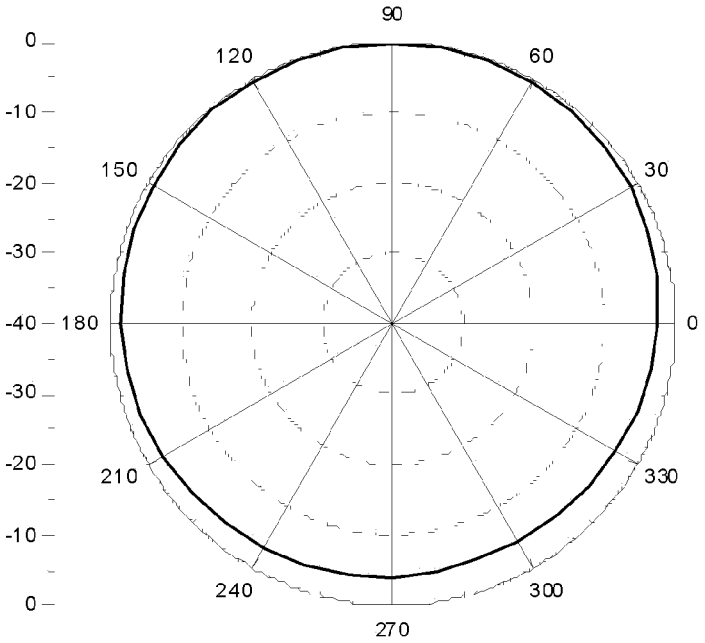
FIG. 9 is a horizontal far-field pattern of the example of the antenna array shown in FIG. 1 at a low-frequency range frequency point.
Figure 10:
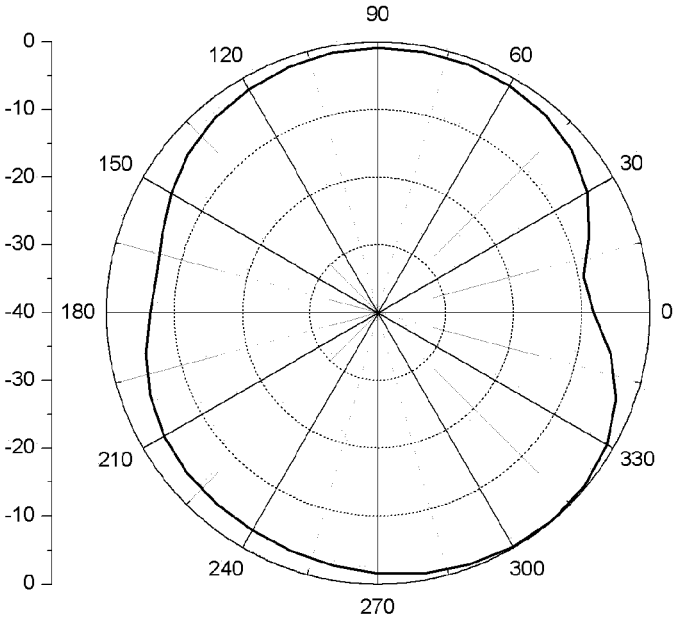
FIG. 10 is a horizontal far-field pattern of the example of the antenna array shown in FIG. 1 at a high-frequency range frequency point.

FIG. 8 is a curve chart of working frequency and coupling unit correlation of the antenna array of the present document. As can be seen from FIG. 8, within the working frequency ranges of the antenna array, the port correlation of all coupling units working at the same frequency range is less than −15 dB. It is indicated that the antenna array of the present document reduces the correlation between the coupling units of the antennas, thus multiple antennas can work well simultaneous within a mobile terminal with an extremely small volume size, FIG. 9 is a horizontal far-field pattern of the antenna array of the present document working at a low-frequency range frequency point 900 MHz. FIG. 10 is a far-field pattern of the antenna array of the present document working at high-frequency range frequency point 2 GHz, and it can be seen that the maximum radiation direction of the antenna array of the present document can keep stable and have the better omnidirectional pattern characteristic.

The above description is only an example of the present document, which does not constitute any limitation on the present document. Apparently, modifications on the structure and parameters of the present document can be made within the conception of the present document to obtain characteristics of integration, multiport and omnidirection of the antenna array of the present document, and all these modifications are covered by the protection of the present document.

INDUSTRIAL APPLICABILITY

Through the antenna array with an integration of antenna and floorboard provided by the present document for the mobile terminal, since the waveguide mode of the floorboard is effectively inspired by utilizing the coupling units, the floorboard becomes the radiation body; compared with the existing self-resonant antennas, it can make the thickness of antennas reduce greatly, which is convenient for the miniaturization design of terminal equipment; since the modular design is adopted, the impedance matching of the coupling units at the required frequency ranges can be implemented by simply adjusting the matching circuits; compared with the traditional self-resonant antennas, the implementation of multi-frequency resonance based on the matching network becomes more visualized; since the radiation floorboard uses a rectangle decoupling structure, the correlation between all the antenna elements can be reduced greatly; a co-frequency range work coupling patch unit is placed at the diagonal position opposite to the radiation floorboard, which can significantly reduce the influence of surroundings on the antenna elements, thereby guaranteeing that the antenna array has better omnidirectional radiation characteristic. Therefore, multiple antennas can work simultaneous within a mobile terminal with an extremely small size, thereby enhancing the spectrum efficiency, increasing the channel capacity, and making that the mobile terminal implements the large volume data transmission of wireless communication system become possible. Consequently, there exists a strong industrial applicability.

What is claimed is:

1. An antenna array of a mobile terminal, comprising a mobile terminal floorboard and multiple pairs of coupling units corresponding to multiple antennas located at a same side of a dielectric material plate, and a matching circuit located at another side of the dielectric material plate, wherein:

the mobile terminal floorboard is configured to: act as a radiation body to radiate antenna energy coupled by multiple coupling units;

each pair of coupling units include two coupling units, the two coupling units are respectively fixed at two ends of the mobile terminal floorboard, and each coupling unit is configured to: inspire a waveguide mode of the mobile terminal floorboard to radiate the coupled antenna energy through feed points of feed lines of each coupling unit; and the matching circuit is connected with the feed points located at the other side of the dielectric material plate, and the matching circuit is configured to: implement impedance matching of the feed lines of each coupling unit.

2. The antenna array according to claim 1, wherein, each pair of coupling units are fixed at front and rear ends and/or top and bottom ends of the mobile terminal floorboard through the feed points of the feed lines of each of the two coupling units contained by each pair of coupling units, each coupling unit is a vertically folded metal patch, and the two coupling units in each pair of coupling units are in a same frequency range, corresponding to a low-frequency range or a high-frequency range, and are placed in diagonal positions of the mobile terminal floorboard.

3. The antenna array according to claim 2, further comprising: a decoupling structure with a polygon shape corroded from a surface of the mobile terminal floorboard close to a coupling unit corresponding to the high-frequency range.

4. The antenna array according to claim 3, wherein, the decoupling structure has a rectangle polygon shape, the rectangle polygon comprises a third long side, a third wide side, an inner long side, an inner wide side and a spacing between the rectangle polygon shape and the mobile terminal floorboard formed by the rectangle polygon shape, and further comprises an outer long side, an outer wide side, and a horizontal distance and a longitudinal distance located at the mobile terminal floorboard with a positional relation in regard to the mobile terminal floorboard.

5. The antenna array according to claim 4, wherein, a matching circuit of the coupling unit corresponding to the low-frequency range comprises lumped elements: a first capacitance, a first inductance and a third inductance connected serially with an input port introduced by the feed points of the feed lines of the coupling unit itself, a second inductance is connected in parallel between a connection point of the first inductance and the third inductance and the coupling unit, 5 and another end of the third inductance is connected with the coupling unit;

a matching circuit of the coupling unit corresponding to the high-frequency range comprises lumped elements: a second capacitance, a fourth inductance and a third capacitance connected serially with an input port introduced by the feed points of the feed lines of the coupling unit itself, a fifth inductance is connected in parallel between a connection point of the fourth inductance and the third capacitance and the coupling unit, and another end of the third capacitance is connected with the coupling unit.

6. The antenna array according to claim 3, wherein, a matching circuit of the coupling unit corresponding to the low-frequency range comprises lumped elements: a first capacitance, a first inductance and a third Inductance connected serially with an input port introduced by the feed points of the feed lines of the coupling unit itself, a second inductance is connected in parallel between a connection point of the first inductance and the third inductance and the coupling unit, and another end of the third inductance is connected with the coupling unit:

a matching circuit of the coupling unit corresponding to the high-frequency range comprises lumped elements: a second capacitance, a fourth inductance and a third capacitance connected serially with an input port introduced by the feed points of the feed lines of the coupling unit itself, a fifth inductance is connected in parallel between a connection point of the fourth inductance and the third capacitance and the coupling unit, and another end of the third capacitance is connected with the coupling unit.

7. The antenna array according to claim 2, wherein, each coupling unit is a vertically folded rectangle metal patch;

a coupling unit corresponding to the low-frequency range is a first coupling unit, and the first coupling unit comprises a first long side, a first short side, a first broadside and a first horizontal spacing of the first coupling unit exceeding the mobile terminal floorboard; a coupling unit corresponding to the high-frequency range is a second coupling unit, and the second coupling unit comprises a second long side, a second short side, a second broadside and a second horizontal spacing of the second coupling unit exceeding the mobile terminal floorboard; a spacing exists between the first coupling unit and 5 the second coupling unit located at the same side; feed points of feed lines of the first coupling unit and feed points of feed lines of the second coupling unit are respectively located at the dielectric material plate.

8. The antenna array according to claim 7, wherein, a matching circuit of the coupling unit corresponding to the low-frequency range comprises lumped elements: a first capacitance, a first inductance and a third inductance connected serially with an input port introduced by the feed points of the feed lines of the coupling unit itself, a second inductance is connected in parallel between a connection point of the first inductance and the third inductance and the coupling unit, and another end of the third inductance is connected with the coupling unit;

a matching circuit of the coupling unit corresponding to the high-frequency range comprises lumped elements: a second capacitance, a fourth inductance and a third capacitance connected serially with an input port introduced by the feed points of the feed lines of the coupling unit itself, a fifth inductance is connected in parallel between a connection point of the fourth inductance and the third capacitance and the coupling unit, and another end of the third capacitance is connected with the coupling unit.

9. The antenna array according to claim 2, wherein, a matching circuit of the coupling unit corresponding to the low-frequency range comprises lumped elements: a first capacitance, a first inductance and a third inductance connected serially with an input port introduced by the feed points of the feed lines of the coupling unit itself, a second inductance is connected in parallel between a connection point of the first inductance and the third inductance and the coupling unit, and another end of the third inductance is connected with the coupling unit;

a matching circuit of the coupling unit corresponding to the high-frequency range comprises lumped elements: a second capacitance, a fourth inductance and a third capacitance connected serially with an input port introduced by the feed points of the feed lines of the coupling unit itself, a fifth inductance is connected in parallel between a connection point of the fourth inductance and the third capacitance and the coupling unit, and another end of the third capacitance is connected with the coupling unit.

10. A method for implementing the antenna array of the mobile terminal according to claim 1, comprising:

at a side of a dielectric material plate configured with a mobile terminal floorboard, combining, in pair, coupling units into multiple pairs of coupling units corresponding to multiple antennas, respectively fixing two coupling units in each pair of coupling units at two ends of the mobile terminal floorboard, and placing a matching circuit configured for impedance matching of feed lines of each coupling unit at another side of the dielectric material plate.

11. The method according to claim 10, wherein, the step of respectively fixing two coupling units in each pair of coupling units at two ends of the mobile terminal floorboard comprises:

combining two vertically folded metal patches into a pair of coupling units, and fixing the pair of coupling units at front and rear ends and/or top and bottom ends of the mobile terminal floorboard through feed points of feed lines of each coupling unit thereof, wherein, the two coupling units in each pair of coupling units are in a same frequency range, corresponding to a low-frequency range or a high-frequency range, and are placed in diagonal positions of the mobile terminal floorboard.

12. The method according to claim 11, wherein, a matching circuit of a coupling unit corresponding to the low-frequency range comprises a first capacitance, a first inductance and a third inductance connected serially with an input port introduced by the feed points of the feed lines of the coupling unit itself, a second inductance is connected in parallel between a connection point of the first inductance and the third inductance and the coupling unit, and another end of the third inductance is connected with the coupling unit;

a matching circuit of the coupling unit corresponding to the high-frequency range comprises a second capacitance, a fourth inductance and a third capacitance connected serially with an input port introduced by the feed points of the feed lines of the coupling unit itself, a fifth inductance is connected in parallel between a connection point of the fourth inductance and the third capacitance and the coupling unit, and another end of the third capacitance is connected with the coupling unit.

13. The method according to claim 11, further comprising:

corroding a decoupling structure with a rectangle polygon shape from a surface of the mobile terminal floorboard close to a coupling unit corresponding to the high-frequency range.

14. The method according to claim 10, further comprising:

corroding a decoupling structure with a rectangle polygon shape from a surface of the mobile terminal floorboard close to a coupling unit corresponding to the high-frequency range.

* * * * *